United States Patent [19]

Grove et al.

[11] 4,331,215

[45] May 25, 1982

[54] CONTROLS FOR AERIAL LIFT PLATFORM APPARATUS

[75] Inventors: John L. Grove, Greencastle; Ernest J. Merz, Chambersburg; Charles W. Walters, Waynesboro, all of Pa.

[73] Assignee: JLG Industries, Inc., McConnellsburg, Pa.

[21] Appl. No.: 120,882

[22] Filed: Feb. 12, 1980

[51] Int. Cl.[3] ..... B66F 11/04; G05G 1/00

[52] U.S. Cl. ..... 182/2; 182/14

[58] Field of Search ..... 182/2, 141, 148, 14; 74/491

[56] References Cited

U.S. PATENT DOCUMENTS

| | | | |
|---|---|---|---|
| 2,659,275 | 11/1953 | Ericsson | 74/491 |
| 2,745,506 | 5/1956 | McCallum | 74/491 |
| 2,977,769 | 4/1961 | Troche | 182/2 |
| 3,066,756 | 12/1962 | Broderson | 182/2 |
| 3,379,279 | 4/1968 | Slusher | 182/2 |
| 3,384,201 | 5/1968 | Fulton | 182/2 |
| 3,424,271 | 1/1969 | Michelson | 182/14 |
| 3,537,246 | 11/1970 | Pool | 74/491 |
| 3,572,467 | 3/1971 | Hall | 182/2 |
| 3,584,705 | 6/1971 | Ruegg | 182/2 |
| 3,880,304 | 4/1975 | Strickland | 214/138 |
| 3,943,791 | 3/1976 | Casey | 74/491 |
| 4,044,856 | 8/1977 | Stevenson | 182/2 |
| 4,160,492 | 7/1979 | Johnston | 182/2 |

*Primary Examiner*—Reinaldo P. Machado
*Attorney, Agent, or Firm*—Irvin A. Lavine

[57] ABSTRACT

Controls for an aerial lift platform apparatus which has a steerable mobile chassis, a rotatable upper works, and an extensible boom pivoted on the upper works for luffing movement. The controls are grouped to provide a first group of control members in physical proximity to each other for controlling upper works movement and a second group of control members for controlling movement of the chassis. Each of these control members is mounted for movement substantially to simulate the movement which is controlled. A third group of control members is for controlling the engine, and are in physical proximity to each other. The control members are mounted on a control console having near-horizontal and near-vertical surfaces from which the control members extend, the vehicle control member for drive and steering extending upwardly from the near-horizontal surface.

25 Claims, 5 Drawing Figures

CONTROLS FOR AERIAL LIFT PLATFORM APPARATUS

BACKGROUND OF THE INVENTION

The present invention relates to aerial lift platform apparatus having an extensible boom.

Aerial platform apparatus having an extensible boom have become widely used during the past decade. This apparatus has a chassis which typically is supported by four wheels, two of which are steerable and two of which are driven by hydraulic motors, either forwardly or in reverse. The chassis rotatably supports an upper works, which may rotate about a vertical axis, being driven by a motor designated as a swing motor. The upper works includes an internal combustion engine and a pump, and has supports for pivotally supporting a boom for luffing movement about a horizontal axis. Luffing is controlled by a lift cylinder. The boom is extended and retracted by a boom cylinder. At its outer end, the boom supports a workman's platform, there being a horizontal pivot adjacent the free end of the boom about which the workman's platform can rotate, primarily to maintain the platform level, and there may also be provided a vertical pivot about which the platform may rotate, so that the platform may be positioned towards either side of the boom. A master cylinder senses the elevation of the boom, and transmits fluid to a slave cylinder, which serves to maintain the platform level. An override provision is made, so that the platform may be tilted, as desired. This conventional construction is provided with controls accessible to the workman in the platform, and these controls have included, in the past, chassis controls for driving and steering the chassis, and have included upper works controls, for swinging the upper works, for luffing the boom, for extending and retracting the boom, and for causing rotation of the platform about the horizontal and vertical axes adjacent the free end of the boom.

In the past, the controls for the various movements of the chassis and of the upper works were positioned primarily with a view towards convenience, and possibly economy of construction. Such controls were not optimum from the human factors point of view for convenience of operation and reliability of anticipated operator response. In this regard. workmen are trained in the operation of the aerial work platform apparatus, these workmen are primarily skilled in other duties, such as painting, reconditioning of equipment, maintenance of equipment and installation of various kinds of equipment and apparatus. While training is given to these workmen in the operation of the aerial work platform apparatus, it is usually an adjunct to their primary work tasks, and therefore may not be completely mastered by a workman, or, where there is a person with relatively little experience in the operation of the aerial work platform apparatus, there is a risk that improper movement of the apparatus may occur, due to a workman being confused, or unfamiliar with the result which will be achieved by the manipulation of a particular control member in a particular manner. This occurs, also, where the workman is in a stress situation, is unduly tired, or is otherwise not as alert as he should be. As a result, a movement is caused which is not actually desired, which could possible lead to either damage to the equipment or injury to the workman, or both. For example, if a drive comand is intended, to move the vehicle in a particular direction, and instead the upper works is swung, an injury or damage could result.

Johnston, U.S. Pat. No. 4,160,492 discloses such an apparatus having a control panel on which levers are provided which combine two different functions, depending upon whether they are moved along a first path, or a second path at right angles to the first path. For example, one lever controls both propel movement of the vehicle, and upper works swinging, while another lever combines boom luffing and vehicle steering.

Slusher, U.S. Pat. No. 3,379,279 discloses a three wheel aerial lift platform apparatus having some movements manually controlled and boom luffing controlled by a foot pedal.

Michelson, U.S. Pat. No. 3,424,271 discloses a three wheel apparatus in which control levers are used to effect both driving and steering, and a foot control is provided to effect raising and lowering of a carriage which supports the workman.

There are also known in the prior art control arrangements for a boom lift mounted on a truck. See, for example, Stevenson U.S. Pat. No. 4,044,856 which has controls with rotary motion, and without any relationship to the motion of the workman's platform resulting from operation of a control, and Hall U.S. Pat. No. 3,572,467 which has a horizontally extending lever, movable about a horizontal axis, for controlling boom telescoping movement.

The control systems and arrangements of the prior art are deficient in not providing a clear separation of control member movements and functions, and in not providing a correspondence of control member movements with movement of the apparatus or the part thereof which is moved as a result of the movement of the control member.

SUMMARY OF THE INVENTION

The present invention provides a control arrangement for the control members to control an aerial lift platform apparatus. A control console is provided which has a first surface which is slightly inclined to the horizontal and a second surface which is slightly inclined to the vertical. The control members which control vehicle movement, that is, drive and steering control members, are mounted on the near-horizontal surface, and extend generally vertically upwardly therefrom, although at a slight angle, for convenience. Movement of the upper end of the drive control lever in the forward direction causes the chassis to drive forward, and movement in the rearward direction causes movement of the chassis in the rearward direction. The steer control lever may be swung to the left to cause left steering of the chassis and swung to the right to cause right steering of the chassis, thereby providing a correspondence between lever movement and vehicle movement. All of the upper works control members are located in close physical proximity. The swing control lever swings about a near-vertical axis and thereby simulates and corresponds to the swinging movement of the upper works, left and right. A boom luffing control lever is provided which is mounted for vertical swinging movement, just as is the boom, with the lever extending from the near-vertical surface, in a generally horizontal manner, so as to generally simulate the position of the boom, with resulting movement of the boom luffing control lever resulting in movement of the boom in the same direction as the lever is moved. A boom extension control member is provided which is pulled toward the operator in order to cause extension of the boom, and is pushed away from the operator in order to cause retraction of the boom, these movements corresponding to the direction of movement of the workman's platform when the boom is extended and retracted. There may be provided, also, a platform rotate control lever for controlling platform rotation mounted for movement so that its free end moves in an arc, in the direction of movement of the platform, left or right. There is provided, also, a platform level override lever for controlling rotation of the platform about a horizontal axis adjacent the end of the boom, this lever being mounted on the near-vertical surface, and having up and down movement in a vertical plane in correspondence with the up and down rotation of the platform in a vertical plane.

Among the objects of the present invention are the provision of an aerial work platform apparatus control arrangement which is efficient, enhancing the ability of a workman to control the movement of the chassis and of the upper works in the manner desired, and a further object is the provision of such a control arrangement which will diminish the risk of inadvertent movement of the chassis or upper works in a direction not desired or actually intended. Yet another object is to enhance the safety of operation of an aerial work platform apparatus.

Other objects and many of the attendant advantages of the present invention will be readily understood in the following specification, claims and drawings.

DESCRIPTION OF THE PREFERRED EMBODIMENT

Figure 1:
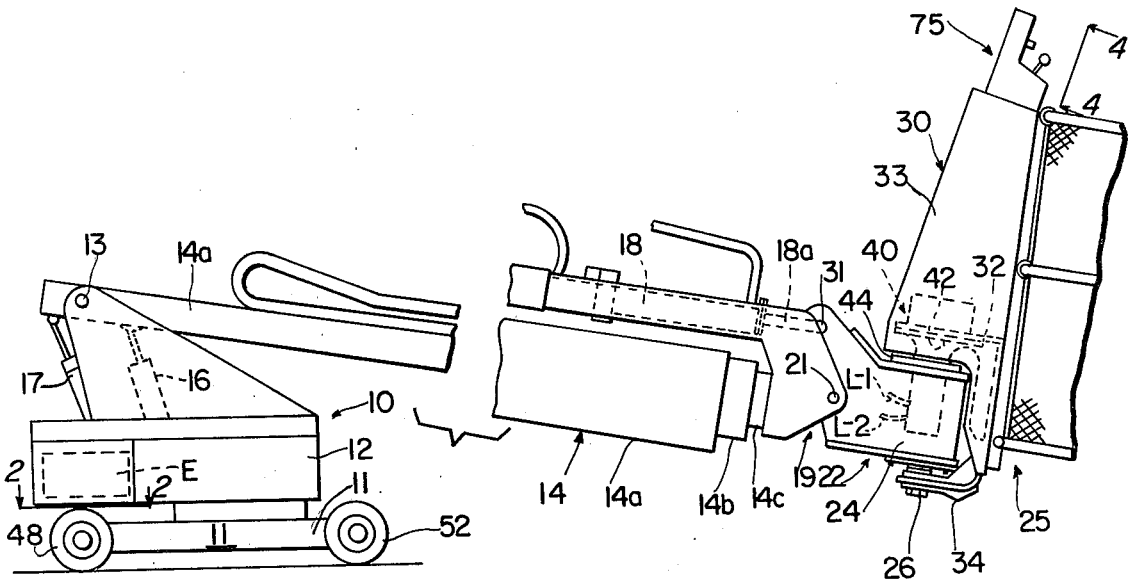
FIG. 1 is an elevational view, with certain parts enlarged and broken away, of an aerial platform apparatus which includes the control arrangement of the present invention.

Referring now to the drawings, wherein like or corresponding reference numerals are used to designate like or corresponding parts throughout the several views, there is shown in FIG. 1 an aerial lift platform apparatus 10 in accordance with the present invention, including a wheeled self-propelled chassis 11 having a rotatable upper works 12 mounted thereon. Upper works 12 may be swung about a vertical axis by a swing motor (not shown in FIG. 1) and has a horizontal pivot 13 which carries the inner end of an extensible, multi-section boom 14. Boom 14 includes a base section **14*a*, a mid-section 14*b* and a fly section 14*c*. A hydraulic motor 16, being a lift cylinder, is carried on the upper works 12, and engages the boom 14, so as to cause luffing movement of boom 14 about the pivotal axis 13. A hydraulic motor 17 of the linerarly extensible type is connected to the upper works 12 and to the rear of boom 14, so as to be actuated upon luffing movement of boom 14. This is a master cylinder of a self-levelling system, the self-levelling system also including a slave cylinder 18 which is carried adjacent the outer end of the fly section 14*c*. Slave cylinder 18 is connected to master cylinder 17 so that as boom 14 is luffed, a workman's platform 25 is rotated on a horizontal pivot, to maintain the floor of platform 25** in horizontal position.

The slave cylinder 18 is supported by support 19 which is secured to the outer end of the fly section **14*c*. Support 19 carries a horizontal pivot 21 and a connector 22 is rotatably supported by the pivot 21. A platform support structure is supported by the connector 22 and in turn supports the platform 25**, usually normal to the boom.

A piston rod **18*a* extends from the slave cylinder 18, and has its end journalled to a pin 31 which is connected to the rear of the connector 22. At its forward end, connector 22 has secured to it a flange 44 of a platform rotating motor 40, being a hydraulically operated rotary motor having a second flange 42 secured to a plate 32 which forms a part of the platform support structure 30**.

Extending from the bottom of the housing 24 of connector 22 is a shaft 26 to which is connected a bracket 34 which extends from and forms a part of the platform support 30. The shaft 26 includes an axis which extends through the motor 40, which axis is perpendicular to the plane containing the floor of the platform 25 and which axis is also transverse to the horizontal pivot 21. Consequently, upon energization of the motor 40, as by supplying fluid through one or the other of the lines L-1 and L-2, the platform support 30 and the platform 25 may be caused to rotate on the axis which extends through the shaft 26 and the rotary motor 40.

A control console 75 is provided, supported by the structure 30, and accessible to a workman standing on the floor of the platform 25.

Figure 2:
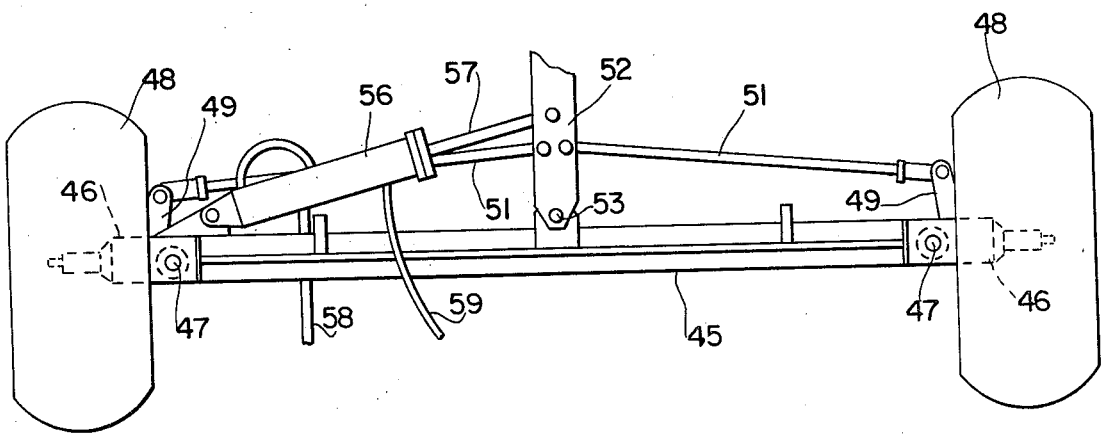
FIG. 2 is a view taken on the line 2—2 of FIG. 1.

Referring now to FIG. 2, there is shown a transverse axle 45 forming a part of the chassis 11, supporting stub axles 46 at either end on joints 47. The stub axles carry steering wheels 48, and the stub axles include ears 49, to which are connected tie rods 51. Tie rods 51 are connected to a steering link 52, pivotally connected at 53 to the transverse axle 45. A steering cylinder 56 is pivotally connected at one end to the transverse axle 45, and has a piston rod 57 journalled to the link 52. Lines 58 and 59 extend to the opposite ends of the steering cylinder 56.

Figure 3:
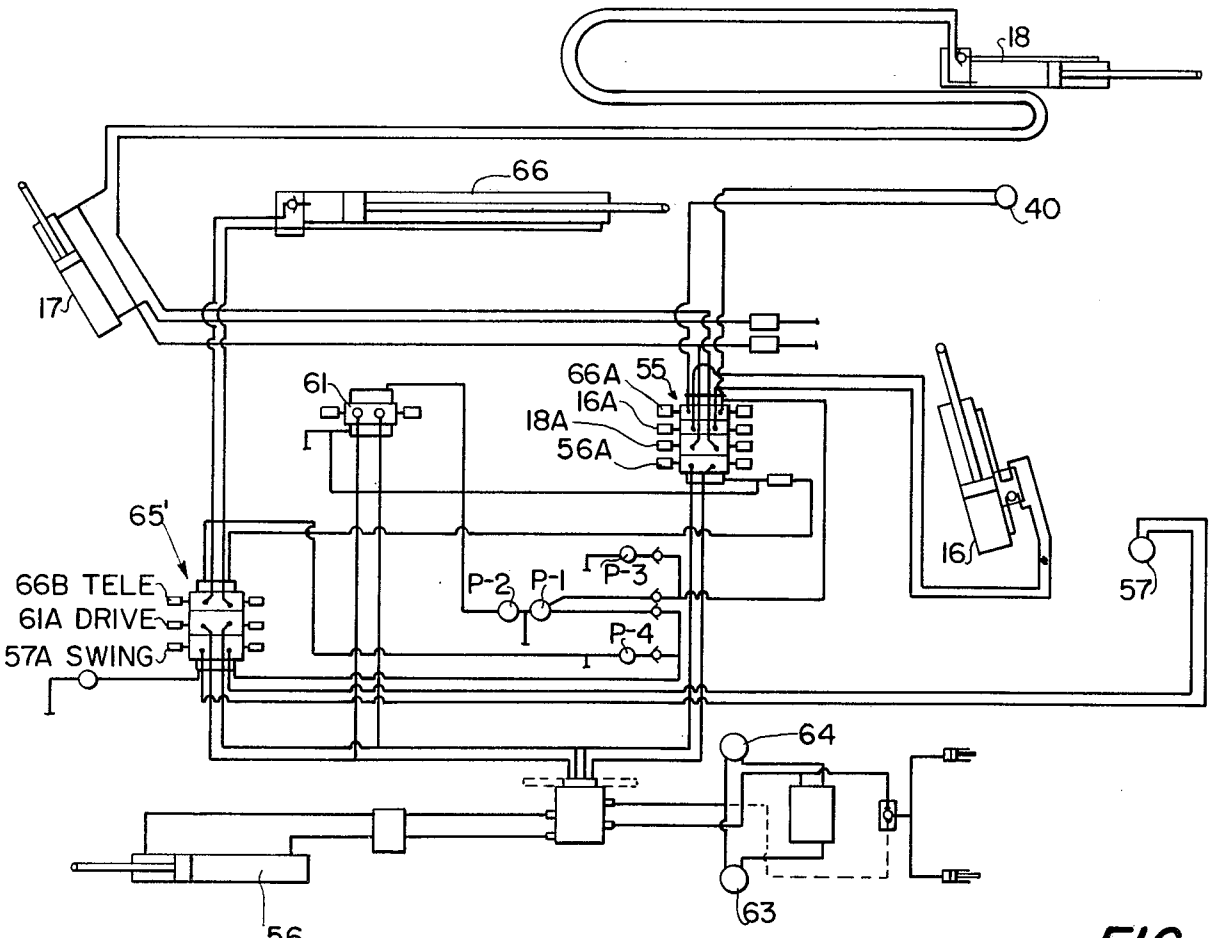
FIG. 3 is a schematic view of a hydraulic system used on the apparatus of FIG. 1.

Referring now to FIG. 3, there is shown a schematic hydraulic diagram of the hydraulic system of the aerial platform apparatus 10. There may be seen the lift cylinder 16, master cylinder 17 and slave cylinder 18. A boom telescope cylinder 66 is provided for effecting telescopic movement of the sections of the boom 14. Motor 57 is the swing motor for swinging the upper works 12, including boom 14. Also shown is rotary motor 40. A pump P-1 and a pump P-2 are provided, for pressurizing the system, and emergency pumps P-3 and P-4 may also be provided. A valve grouping 55 is schematically indicated, and includes telescope control valve 66A which is shifted to control movement of the telescope cylinder piston 66, a lift control valve 16A for controlling operation of lift cylinder 16 and an override control valve **18*a* for conducting fluid from the pump P-1 to one end or the other of the slave cylinder 16, operation of which will cause the connector the connector 30 and the platform 25 to rotate about the horizontal pivotal axis 21. A steering valve 56*a* is provided to connect the pump to the steering cylinder 56. A valve 61 is connected to drive motors 63 and 64, each of which is connected with one of the ground engaging wheels 62**, to cause these latter wheels to drive either forwardly or in reverse.

The valve grouping 55' may be provided, as an auxiliary, having a separate telescope control valve 66B, drive control valve 61A and swing control valve 57A providing a duplicate or auxiliary control set up, as is conventional.

The structure shown in FIGS. 1 and 3 is known in the art, as in Grove U.S. Pat. No. 3,809,180, and the structure shown in FIG. 2 is also known in the art, as in Grove U.S. Pat. No. 3,874,473.

Figure 4:
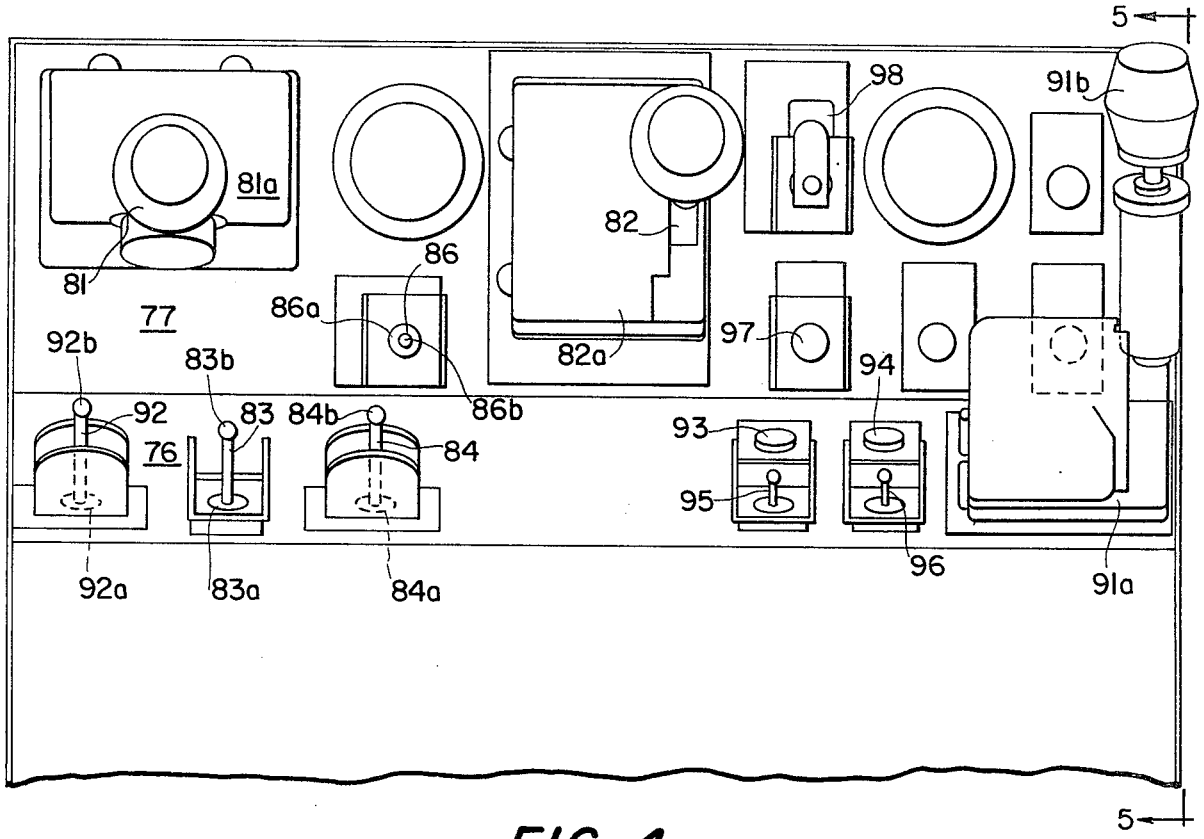
FIG. 4 is a view taken on the line 4—4 of FIG. 1, to an enlarged scale.
Figure 5:
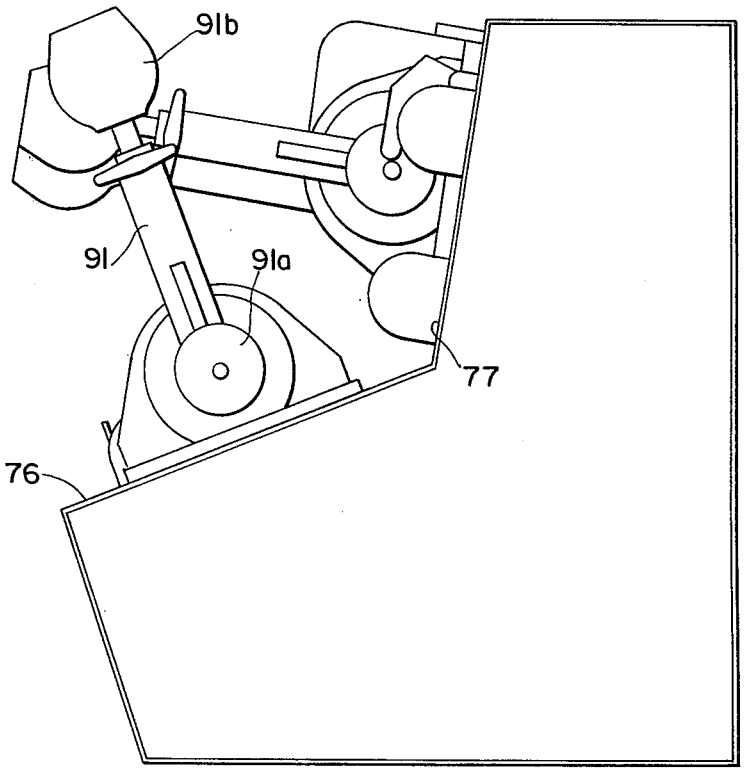
FIG. 5 is a view taken on the line 5—5 of FIG. 4.

Referring now to FIGS. 4 and 5, there is shown a control console in accordance with the present invention, generally designated 75, and including a first surface 76 which is slightly inclined to the horizontal, and a second surface 77, which is slightly inclined to the vertical. A first group of control members for controlling the movements of the various elements of the upper works is provided, and, as is clearly shown in FIG. 4, this group includes control members which are arranged in physical proximity to each other. Thus, the upper works control members includes a swing control lever 81 for controlling the swing motor 57; the inner end of the lever 81 is journalled in a housing 81*a* which mounts the swing control lever 81 so that the free end thereof swings about a substantially vertical axis, in a substantially horizontal plane, swinging the lever 81 to the left causing the upper works to swing to the left, and vice versa.

A second member of the upper works control elements is the boom luffing control lever 82 which extends generally horizontally, and is mounted in a housing 82*a* for swinging movement in a vertical plane, about a horizontal axis at the inner end of the lever 82. Boom luffing control lever 82 controls the lift cylinder 16, and due to the mounting of the housing 82*a*, when the outer end of lever 82 is raised, the boom will be raised or luffed, and when the outer end of lever 82 is caused to be lowered, the cylinder 16 will cause the boom 14 to be lowered. Thus, the movement of the free end of lever 82 is in substantially the same direction as the movement which is made by the platform 25, upon manipulation of lever 82.

A boom extension control lever 83 is provided, extending substantially vertically from the surface 76, being provided in a housing 83*a*, which restricts the movement of lever 83 to swinging movement about a transverse horizontal axis, with the lever 83 moving in a vertical plane. Lever 83 has a hand engaging portion or knob 83*b*, and as will be understood, since a view of FIG. 4 is substantially the view which a workman on the platform has, moving the knob or portion 83*b* toward him will cause the telescope cylinder 56 to go to the extend mode, thereby the end portion 83*b* will move away from the inner end of the boom 14, and the entire platform 25 will also move away from the inner end of boom 14. This latter is due, of course, to boom extension. On the other hand, when the end portion 83*b* of lever 83 is moved toward the inner end of the boom 14, the cylinder 56 will cause the boom 14 to retract and the platform 25 will move toward the inner end of the boom 14.

Adjacent the boom extension control member or lever 83 is a platform rotate control lever 84 supported in a housing 84*a*, lever 84 having a free end 84*b*. Housing 84*a*, in known fashion, restricts the movement of lever 84 to a substantially vertical plane extending transversely of the console 75, and movement of lever 84 to the left causes the rotary motor 40 to rotate the platform 25 to the left, and movement of lever 84 to the right causes the rotary motor 40 to rotate the platform to the right.

To the left of the lift or luffing lever 82 is the platform level override lever 86, only the free end 86*b* being shown. Lever 86 has its inner end supported in a housing 86*a* which restricts its movement to a vertical plane, about a transverse horizontal axis. Thus, when the end 86*b* is moved downwardly, hydraulic fluid is supplied to the slave cylinder 18, to cause it to rotate platform 25 about horizontal pivot 21 (see FIG. 1), thereby deliberately causing the floor of platform 25 to be inclined. Upon upward movement of the end portion 86*b*, the platform 25 will be caused to rotate in the upward direction about the pivot 21.

Extending from the surface 76 is a second group of control members, these for controlling the movement of the chassis. These include a drive control lever 91 and a steer control lever 92. Lever 91 has its inner end mounted in a housing 91*a*, so that the free end 91*b* thereof, when moved forwardly causes the motors 63 and 64 to drive the drive wheels 62 so that the apparatus 10 moves forwardly, and movement of the free end 91*b* rearwardly causes the apparatus to move rearwardly. The steering control lever 92 is mounted in a housing 92*a* which restricts the movement of the free end 92*b* to a plane perpendicular to the plane of the paper as shown in FIG. 5, movement of end 92*b* to the left causing the steering motor 56 to swing the wheels 48 to the left, and movement thereof to the right causes the wheels 48 to move to the right, thereby effecting substantially the same direction of movement of the chassis as the end 92*b* is moved.

The drive control lever 91 is adjacent the right end of the console 75, and the steering control lever 92 is adjacent the left end of the console 75. Thus, these chassis movement controlling levers are relatively widely horizontally spaced, being approximately fourteen inches apart, in practice. A spacing of at least twelve inches provides the operator, during driving and steering movement, with stability, due to the spreading apart of his hands on these two levers. When the apparatus 10 is moved from place to place, due to the fact that the operator is on the platform at the end of the boom, surface irregularities are amplified by the lever action of the boom, creating a significant motion in the platform, so that the placement of the chassis control members forming the second group relatively widely spaced apart enhances the stability of the operator. Between the vertical planes containing the levers 91 and 92 are the control members of the second group, as well as the engine control members, forming the third group, discussed hereinbelow.

As shown in FIG. 4, immediately to the left of the drive control lever 91 are a start button 93 and a choke button 94, of known construction and function. These are in close proximity to each other, so that they may be engaged simultaneously by two forefingers of one hand of the operator. Adjacent start button 93 is a drive speed control lever 95, and adjacent the choke button 94 is an engine speed control lever 96. Also provided are an auxiliary power button 97, and an emergency stop control 98. The controls of the third group, just described, are in close physical proximity to each other, and control the engine E, which is an internal combustion engine and which provides the source of power for the apparatus 10.

In the operation of an apparatus 10 in accordance with the present invention, a workman will enter the platform 25 when it is at ground level. By using the third group of controls, the engine will be started, with utilization of the choke, if necessary, engine speed will be set, and the engine will drive the pumps shown in FIG. 3. The boom luffing control lever 82 will be raised, so as to luff or raise the boom. Then the workman will move the apparatus 10, utilizing the drive control lever 91 for forward or reverse movement of the apparatus 10, and simultaneously, as necessary, moving the steering control lever 92 to steer the apparatus 10. Thus, during movement of apparatus 10 from one location to another, the workman will be concerned only with the levers 91 and 92, both of which form a group of levers extending upwardly from the near-horizontal surface 76. Upon arriving at a work location, these two levers are, for the most part, no longer used, the workman utilizing the levers of the first group, which are in close physical relationship, to effect boom luffing by lever 82, upper works rotation or swinging by lever 81, and boom extension and retraction by lever 83. These are the major operational levers for the upper works. To a lesser extent there are used the platform level override lever 86 and the platform rotate lever 84. All five of the control members forming the first group are, as shown, physically close together, and as a result, the natural tendency of the workman will be to distinguish between upper works movement control levers, on the one hand, and vehicle control levers on the other hand. This will tend to insure against inadvertent operation of, for example, a drive lever when it is intended to utilize the boom luffing control lever. Further, each of the control members is so mounted that the end thereof which is engaged by the workman is restricted to movement in a manner substantially simulating the movement which is effected by that lever, such as lift, swinging, forward and reverse, left and right steering, etc. This takes advantage of the natural tendency of the workman, even a workman not thoroughly familiar with the machine, to cause movement of a control member in the same direction as the movement which is desired. This greatly improves the efficiency and enhances the safety of operation of the machine, tending to avoid confusion and mistake in operation, either of an unwanted control member, or in an undesired direction of movement of the control member.

It will be obvious to those skilled in the art that various changes may be made without departing from the spirit of the invention, and therefore the invention is not limited to what is shown in the drawings and described in the specification but only as indicated in the appended claims.

We claim:

1. An aerial lift platform apparatus comprising a chassis, driving and steering means for supporting the chassis, an upper works, means supporting the upper works for rotational movement on the chassis, means for rotating the upper works, an extensible boom pivotally mounted at its inner end on the upper works, means for luffing the boom, means for extending and retracting the boom, a workman's platform supported adjacent the free end of the boom, and control means comprising:

(a) a first group of control members accessible to a workman on the platform for controlling upper works movements and comprising:

(i) a swing control lever for controlling said upper works rotating means, means mounting said swing control lever for swinging movement of the free end thereof in substantially the same direction as the platform moves upon manipulation of said swing control lever, (ii) a boom luffing control lever for controlling the boom luffing means, means mounting the boom luffing control lever for movement of the free end thereof in substantially the same direction as the platform moves upon manipulation of said boom luffing control lever, (iii) a boom extension control member for controlling the boom extension means having a hand engaging end portion, and means mounting the boom extension control member for movement of the said end portion away from the boom inner end to cause boom extension and toward the boom inner end to cause boom retraction, and (b) a second group of control members for controlling the movement of the chassis and comprising:

(i) a drive control lever for controlling forward and reverse drive of the chassis, and means mounting said lever for movement of the free end thereof in substantially the same direction as the chassis upon manipulation of the drive control lever, and (ii) a steering control lever for controlling the chassis steering means, means mounting said steering control lever for movement of the free end thereof in substantially the same direction as the chassis is steered upon manipulation of the steering control lever.

2. The apparatus of claim 1, said apparatus further comprising means supporting said workman's platform for rotation on a substantially vertical axis adjacent the free end of the boom, means for rotating said workman's platform about said last mentioned axis, said first group of control members further comprising a platform rotate control lever for controlling platform rotation and having a free end, and means mounting said platform rotate control lever for movement of said free end, in substantially the same direction of movement of said platform as said platform rotates about said last mentioned axis upon movement of said platform rotate control lever.

3. The apparatus of claim 1, and further comprising means supporting the workman's platform for rotation about a horizontal axis adjacent the free end of the boom, means for causing rotation of said platform about said last mentioned axis, said first group of control members further comprising a platform level override lever for controlling rotation of said platform about said last mentioned axis, and means mounting said platform level override control lever for movement of the free end thereof in substantially the same direction as the platform moves upon manipulation of said platform level override control lever.

4. The apparatus of claim 1, and a control console having a substantially horizontal surface and a substantially vertical surface adjacent thereto, the controls of the second group extending upwardly from said substantially horizontal surface.

5. Th aerial lift platform apparatus of claim 1, wherein said first group of control members are arranged in physical proximity to each other.

6. The aerial lift platform apparatus of claim 1, wherein said swing control lever extends substantially horizontally and said swing lever mounting means mounts said lever for rotation on a substantially vertical axis.

7. The aerial lift platform apparatus of claim 1, wherein said boom luffing control lever extends substantially horizontally and said mounting means therefor mounts said luffing control lever for rotation on a substantially horizontal axis.

8. The aerial lift platform apparatus of claim 1, wherein said boom extension control member comprises a lever extending substantially vertically upwardly, said end portion being at the top thereof, said mounting means therefor mounting said last mentioned lever for rotation about a horizontal axis extending transversely of the axis of the boom, when the platform transverse axis is substantially prependicular to the boom axis.

9. The aerial lift platform apparatus of claim 1, wherein said drive control lever extends substantially vertically upwardly from the mounting means therefor, said mounting means therefor mounting said last mentioned lever for rotation about a horizontal axis extending transversely of the boom axis when the platform transverse axis is substantially perpendicular to the boom axis.

10. The aerial lift platform apparatus of claim 1, wherein said steering control lever extends substantially vertically upwardly from the mounting means therefor, said mounting means therefor mounting said last mentioned lever for rotation about a horizontal axis parallel to the boom axis when the platform axis is substantially perpendicular to the boom axis.

11. The aerial lift platform apparatus of claim 10, wherein said drive control lever extends substantially vertically upwardly from the mounting means therefor, said mounting means therefor mounting said last mentioned lever for rotation about a horizontal axis extending transversely of the boom axis when the platform transverse axis is substantially perpendicular to the boom axis, and a control console having a substantially horizontal surface, said drive control lever and said steering control lever extending upwardly from said surface, and each being spaced apart substantially the length of said surface.

12. The aerial lift platform apparatus of claim 1, and further comprising a source of power, and a third group of control members for controlling the operation of said source of power, said third group of control members being in physical proximity to each other.

13. The aerial lift platform apparatus of claim 12, said source of power being an internal combustion engine, said third group of control members comprising a start button and a choke button, said buttons being located within the span of two fingers of a human hand.

14. The aerial lift platform apparatus of claim 1, said control members of the second group being horizontally spaced apart from each other at least approximately twelve inches.

15. An aerial lift platform apparatus comprising a chassis, driving and steering means for supporting the chassis, a source of power, an upper works, means supporting the upper works for rotational movement on the chassis, means for rotating the upper works, an extensible boom pivotally mounted at its inner end on the upper works, means for luffing the boom, means for extending and retracting the boom, and control means comprising:

(a) a first group of control members accessible to a workman on the platform for controlling upper works movements, (b) mounting means for each said control members for movement of the free end thereof in substantially the same direction as the movement of the upper works and the components thereof effected by movement of each said control member, (c) a second group of control members accessible to a workman on the platform for controlling driving and steering movements of said chassis, (d) mounting means for each of the control members of the second group for movement of the free end thereof in substantially the same direction as the movement of the chassis in driving and steering which is effected by movement of each said control member of the second group, and (e) a third group of control members for controlling the operation of said source of power, said third group of control members being in physical proximity to each other.

16. The aerial lift platform apparatus of claim 15, wherein the members of said first group of control members are arranged in physical proximity to each other.

17. The aerial lift platform apparatus of claim 15, wherein said first group comprises:

(i) a swing control lever for controlling said upper works rotating means, means mounting said swing control lever for swinging movement of the free end thereof in substantially the same direction as the platform moves upon manipulation of said swing control lever, (ii) a boom luffing control lever for controlling the boom luffing means, means mounting the boom luffing control lever for movement of the free end thereof in substantially the same direction as the platform moves upon manipulation of said boom luffing control lever, and (iii) a boom extension control member for controlling the boom extension means having a hand engaging end portion, and means mounting the boom extension control member for movement of the said end portion away from the boom inner end to cause boom extension and toward the boom inner end to cause boom retraction.

18. The aerial lift platform apparatus of claim 15, wherein the members of the second group comprise a drive control lever and a steering control lever, a console, said drive control lever and said steering control lever mounted on said control console at opposite ends thereof, with the members of the first group between the vertical planes in which said drive control and steering control levers lie.

19. The aerial lift platform apparatus of claim 15, wherein the members of the second group comprise a drive control lever, a steering control lever horizontally spaced at least approximately twelve inches therefrom.

20. An aerial lift platform apparatus comprising a chassis, driving and steering means for supporting the chassis, a source of power, an upper works, means supporting the upper works for rotational movement on the chassis, means for rotating the upper works, an extensible boom pivotally mounted at its inner end and on the upper works, means for luffing the boom, means for extending and retracting the boom, and control means comprising:

(a) a group of control members accessible to a workman on the platform for controlling upper works movements, (b) mounting means for each said control members for movement of the free end thereof in substantially the same direction as the movement of the upper works and the components thereof effected by movement of each said control member.

21. The aerial lift platform apparatus of claim 20, wherein said control members comprises at least one of the following:

(i) a swing control lever for controlling said upper works rotating means, means mounting said swing control lever for swinging movement of the free end thereof in substantially the same direction as the platform moves upon manipulation of said swing control lever, (ii) a boom luffing control lever for controlling the boom luffing means, means mounting the boom luffing control lever for movement of the free end thereof in substantially the same direction as the platform moves upon manipulation of said boom luffing control lever, and (iii) a boom extension control member for controlling the boom extension means having a hand engaging end portion, and means mounting the boom extension control member for movement of the said end portion away from the boom inner end to cause boom extension and toward the boom inner end to cause boom retraction.

22. The aerial lift platform apparatus of claim 20 or claim 21, and further comprising:

(a) a second group of control members accessible to a workman on the platform for controlling driving and steering movements of said chassis, (b) mounting means for each of the control members of the second group for movement of the free end thereof in substantially the same direction as the movement of the chassis in driving and steering which is effected by movement of each said control member of the second group.

23. The aerial lift platform apparatus of claim 20 or 22, and further comprising:

another group of control members for controlling the operation of said sources of power, said other group of control members being in physical proximity to each other.

24. An aerial lift platform apparatus comprising a chassis, driving and steering means for supporting the chassis, a source of power, an upper works, means supporting the upper works for rotational movement on the chassis, means for rotating the upper works, an extensible boom pivotally mounted at its inner end on the upper works, means for luffing the boom, means for extending and retracting the boom, and control means comprising:

(a) a group of control members accessible to a workman on the platform for controlling driving and steering movements of said chassis, (b) mounting means for each of the control members of the second group for movement of the free end thereof in substantially the same direction as the movement of the chassis in driving and steering which is effected by movement of each said control member of the second group.

25. The aerial lift platform apparatus of claim 24, and further comprising a second group of control members for controlling the operation of said source of power, said second group of control members being in physical proximity to each other.

* * * * *